United States Patent [19]

Kupersmit

[11] 4,358,049

[45] Nov. 9, 1982

[54] COLLAPSIBLE SHIPPING CONTAINER WITH REINFORCING INSERT

[76] Inventor: Julius B. Kupersmit, 145-80 228th St., Springfield Gardens, N.Y. 11413

[21] Appl. No.: 257,106

[22] Filed: Apr. 24, 1981

[51] Int. Cl.[3] ..... B65D 19/20; B65D 5/36

[52] U.S. Cl. ..... 229/41 R; 229/23 R

[58] Field of Search ..... 229/6 R, 23 R, 41 R, 229/41 B, 23 BT; 220/441, 443, 416

[56] References Cited

U.S. PATENT DOCUMENTS

| | | | |
|---|---|---|---|
| 2,766,921 | 10/1956 | Jones | 229/23 R |
| 3,291,364 | 12/1966 | Fischer | 229/23 R |
| 3,337,036 | 8/1967 | Peterson | 229/23 R |
| 3,376,994 | 4/1968 | Flinn | 229/41 R |
| 3,643,856 | 2/1972 | Jones | 229/23 R |
| 3,770,186 | 11/1973 | Kupersmit | 229/23 R |
| 3,917,154 | 11/1975 | Dove | 220/441 |
| 4,085,847 | 4/1978 | Jacalone | 229/23 BT |
| 4,087,041 | 5/1978 | Centanni | 220/441 |
| 4,252,266 | 2/1981 | Kupersmit | 229/23 R |

*Primary Examiner*—Herbert F. Ross
*Attorney, Agent, or Firm*—Charles E. Temko

[57] ABSTRACT

A collapsible shipping container the side walls of which are foldable when not in use. A foldable reinforcing insert consisting solely of side walls adapted to overlie the foldable side walls of the container which reinforces them against outwardly directed bulging under heavy loading of particulate materials.

1 Claim, 5 Drawing Figures

COLLAPSIBLE SHIPPING CONTAINER WITH REINFORCING INSERT

BACKGROUND OF THE INVENTION

This invention relates generally to the field of collapsible reusable shipping containers of the type disclosed in my prior U.S. Pat. No. 3,443,737, granted Apr. 13, 1969, and my prior U.S. Pat. No. 4,252,266, granted Feb. 24, 1981; and more particularly to an improved form thereof.

Shipping containers of this type are primarily used for air and truck transport, where space and weight considerations are of greater importance than the cost of fabrication. In the latter of my above mentioned patents, there is disclosed an improved form in which the conventional wood or synthetic resinuous pallet has been substituted by an integral base element which not only saves a substantial amount of cargo space in the transporting vehicle, but provides a degree of rigidity to the device which is more than adequate quate for most loads provided that the container is not of excessive size.

While the base element provides such rigidity as a result of the gluing of foldable tabs integrally formed with the lower edges of the side walls, and the side walls themselves possess substantial tensil and compressive strength in the plane thereof, when such devices are used for the transportation of relatively heavy particulate loads, the side walls of the container do not always exhibit the desired degree of resistance to outward bulging in response to stresses exerted by the load in planes normal to the planes of the side walls. Under such circumstances, it is possible to increase the thickness of the side walls. However, where more than two plys of corrugation are involved, it becomes increasingly difficult to fold the walls in a manner necessary to place the container in collapsed condition.

SUMMARY OF THE INVENTION

Briefly stated, the invention contemplates, in a device of the above described type, the provision of a separable collapsible reinforcing liner element which may be, in erected condition, placed within an erected container to reinforce the vertical walls thereof against outward bulging forces exerted by heavy particulate loads, and in collapsed condition stored in a position parallel to the collapsed side walls of the container beneath a cover element. The fold lines of the liner when installed are not in juxtaposed relation to the fold lines of the side walls, in the interest of imparting maximum rigidity to the side walls.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 1:
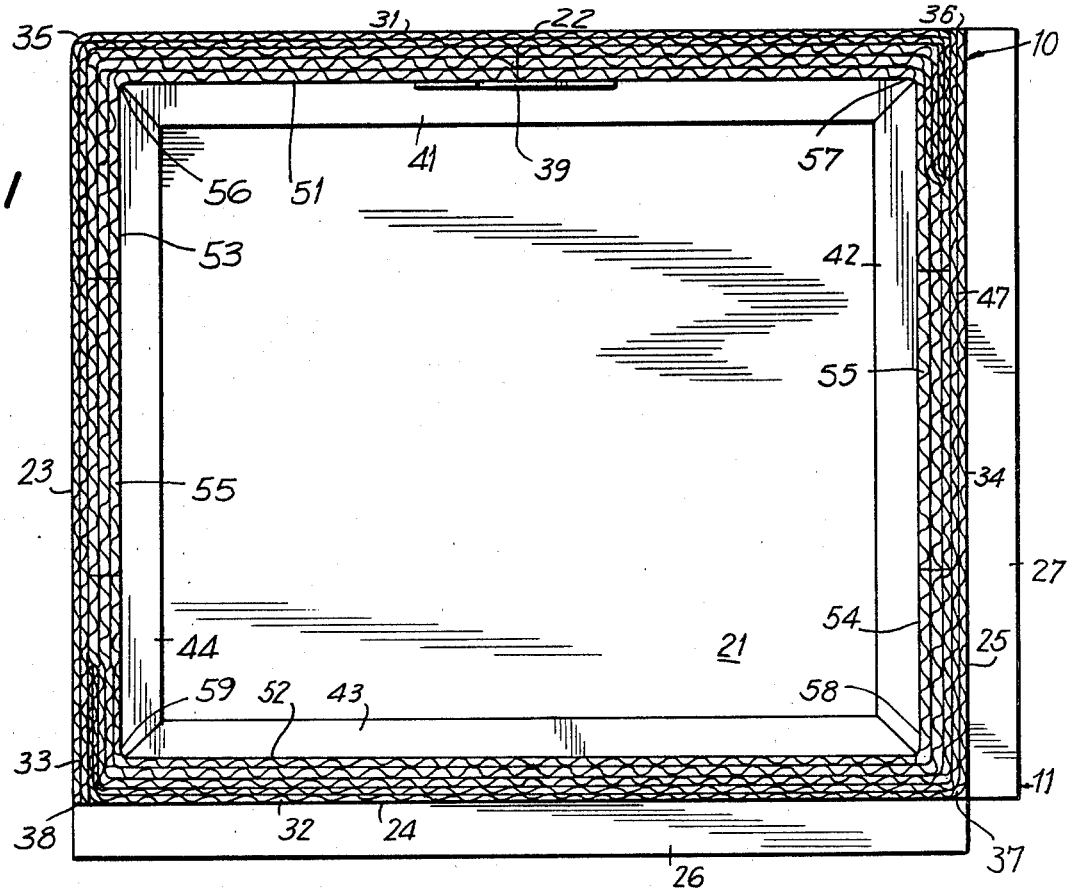
FIG. 1 is a top plan view of an embodiment of the invention with liner element in position and cover element removed.
Figure 2:
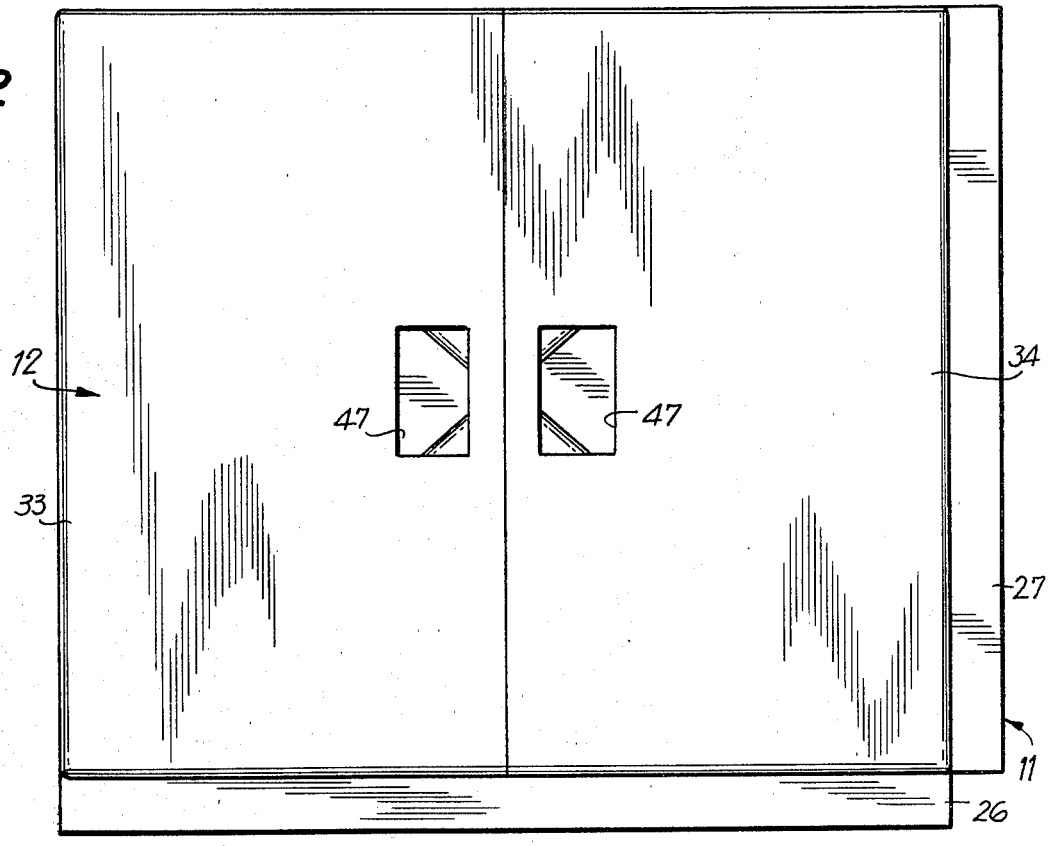
FIG. 2 is a top plan view thereof in collapsed condition with the liner element removed.

In accordance with the invention, the device, generally indicated by reference character 10, comprises broadly: a base element 11, a side wall element 12, a reinforcing element 13, and a cover or lid element 14.

The base element 11 is preferably of fiber board, but may be of corrugated board, and is bounded by an upper surface 21, a lower surface (not shown), side edges 22 and 23 and fold edges 24 and 25 interconnecting lip members 26 and 27, respectively, which facilitate engagement by forklift means, as described in my above mentioned U.S. Pat. No. 4,252,266.

The side wall element 12 may be formed from a single blank of corrugated material, and includes a pair of side walls 31 and 32, as well as a pair of end walls 33 and 34 joined by corner fold lines 34, 36, 37 and 38. One of the walls is provided with a vertical gluing tab 39, and each of the walls includes a horizontal gluing tab at 41, 42, 43 and 44 foldably interconnected to the lower fold edge of each wall. These tabs are glued on the lower surface thereof to the upper surface 20 of the base element 11. Each of the side walls 31 and 32 is provided with angularly disposed score lines 45 which permit the same to be folded wherein the element 12 they lie in a plane substantially parallel to that of the base element 11. The end walls 33 and 34 may be provided with rectangular openings 47 to accommodate known clip elements serving to hold the cover element 14 in position.

Figure 3:
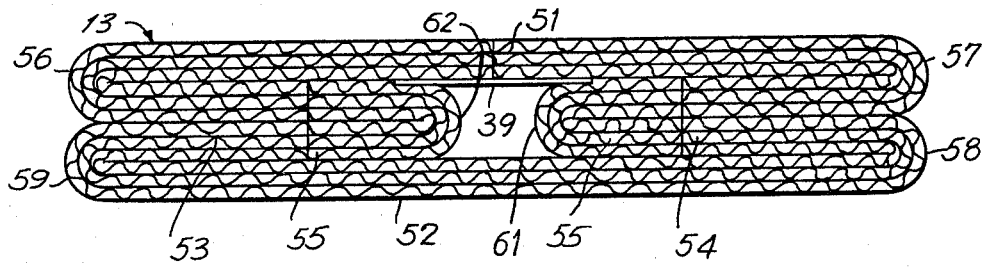
FIG. 3 is a top plan view of the liner element in collapsed condition.

The reinforcing element 13 is preferably of three-ply thickness, and includes a pair of side walls 51 and 52, and a pair of end walls 53 and 54. Cutouts 55 are positioned so as to lie in substantially congruent relation with respect to the openings 47 when the element 13 is positioned within the element 12. The walls 51 to 54, inclusive, are interconnected at vertical fold lines 56, 57, 58 and 59 at the corners thereof. Medially positioned fold lines 61 and 62 permit the element 13 to be flattened as shown in FIG. 3 for storage when the device 10 is in collapsed condition.

Figure 4:
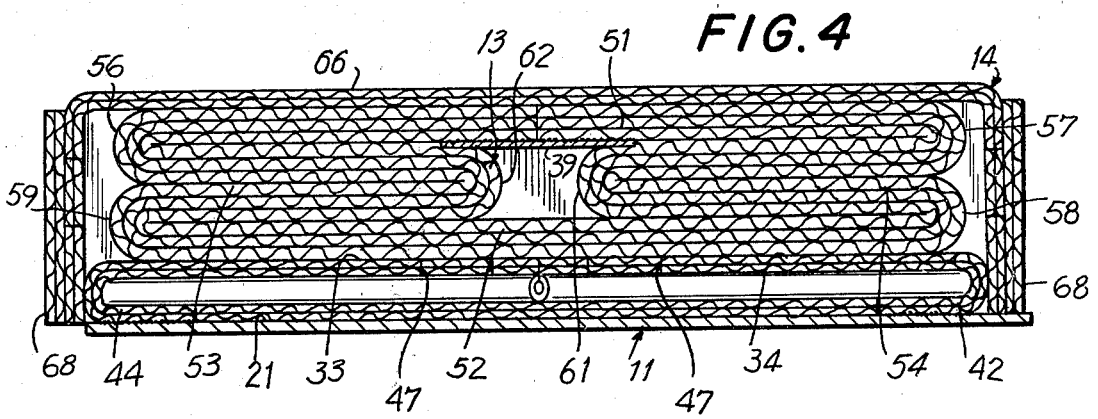
FIG. 4 is a central sectional view of the embodiment in condition for storage with cover element in place.
Figure 5:
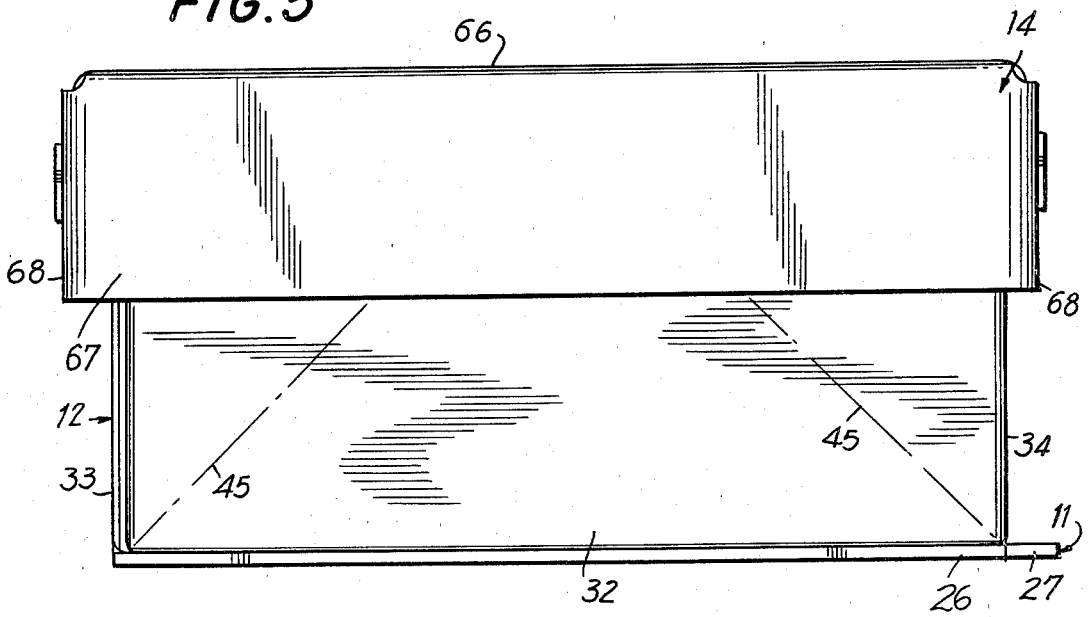
FIG. 5 is a side elevational view of the embodiment in erected condition.

The cover element 14 includes a top wall 66, side walls, one of which is indicated by reference character 67, and end walls 68, the side and end walls being of a height sufficient to permit the inner surfaces thereof to engage the folded side wall element 12 and overlie the upper surface 20 of the base element when the device is in collapsed condition, while providing sufficient storage space for the collapsed reinforcing element 13 as illustrated in FIG. 4. Thus, to erect the device for use, it is necessary only to remove the cover, expand the reinforcing element, unfold the side wall element and place the expanded reinforcing element within the recess formed by the side wall element. The device may then be loaded with fluid or particulate material. The cargo will immediately provide horizontally oriented stresses which will expand the reinforcing element against the side wall element, wherein the side wall element and corresponding walls of the reinforcing element will provide a multi-ply thickness adequate to resist these stresses. Upon emptying the cargo, the reinforcing element is lifted out of engagement with the side wall element, and both such elements are collapsed to the original condition, following which the lid may be placed in position to engage the collapsed side wall element and maintain integrity during storage and return transport operations.

I wish it to be understood that I do not consider the invention limited to the precise details of structure shown and set forth in this specification, for obvious modifications will occur to those skilled in the art to which the invention pertains.

I claim:

1. In a collapsible shipping container including a planar base element, an integrated side wall element, a lid element and a reinforcing element; said base element including a planar wall, said wall having upper and lower surfaces, and four peripheral side edges; said side wall element including a plurality of foldably interconnected planar walls corresponding in width to said peripheral side edges of said base element, each of said walls having a lower fold edge, a gluing flap secured at a respective fold edge to each of said walls, and to said upper surface of said base element along said peripheral side edges; at least two of said side walls having angularly disposed fold lines for collapsing said side wall element into a plane substantially parallel to that of said base element; said reinforcing element including four hingedly interconnected walls corresponding in height to that of said wall element, and being removably positioned between the walls of said side wall element to lie in substantially abutted relation therewith; said reinforcing element being foldable to substantially planar condition for storage beneath said cover element and above said side wall element when said container is in collapsed condition.

* * * * *